United States Patent [19]

Moffatt

[11] Patent Number: 4,459,941

[45] Date of Patent: Jul. 17, 1984

[54] ANIMAL HANDLING DEVICE

[76] Inventor: Gregory C. Moffatt, Gorge Rd., Otaki, New Zealand

[21] Appl. No.: 400,033

[22] Filed: Jul. 20, 1982

[51] Int. Cl.[3] ..... A61D 3/00

[52] U.S. Cl. ..... 119/103

[58] Field of Search ..... 119/96, 103, 98

[56] References Cited

U.S. PATENT DOCUMENTS 4,350,121 9/1982 Lemin ..... 119/103

FOREIGN PATENT DOCUMENTS 222776 1/1959 Australia ..... 119/103
34689 3/1952 Poland ..... 119/103
17708 8/1916 United Kingdom ..... 119/103
745517 7/1980 U.S.S.R. ..... 119/103

*Primary Examiner*—Jay N. Eskovitz
*Attorney, Agent, or Firm*—Scully, Scott, Murphy & Presser

[57] ABSTRACT

In FIG. 5 a sheep shearing table (1) includes a pair of rollers (3) rotatable about respective shafts (31) in a common direction so as to rotate a sheep placed thereon and faciliate its being sheared. The legs of the sheep are tethered by rope passing through cleats (11) and the rollers are driven by operation of a foot operated lever (16) through a releasable drive coupling (7) which can be released when the rollers (3) are required to be swivelled and pivoted relative to the base (3) about a joint (4). The bracket (9) can then rest on the ground and enabling a sheep to be loaded on to the rollers (3) for subsequent shearing or a sheared sheep to be released into the tally pen.

11 Claims, 12 Drawing Figures

ANIMAL HANDLING DEVICE

This invention relates to improvements in and relating to animal handling devices and more particularly to a device facilitating the speedy and efficient shearing of a sheep.

Various proposals have in the past been put forward in an attempt to maximize the efficiency with which large numbers of sheep can be shorn.

However to the present time it is still customary for sheep to be shorn by being held on the ground by the shearer while the various shearing strokes remove the fleece.

It is an object of the present invention to facilitate the efficient handling of a sheep before, during and subsequent to its being sheared and avoiding the necessity for the shearer to bend his back during the shearing operation.

According to one embodiment of the present invention there is thus provided an animal handling device for shearing of sheep comprising a support frame and a sub-frame coupled thereto enabling tilting and rotational movement therebetween, said sub-frame including a pair of elongate rollers adapted to be rotated in a common direction and to receive and rotate a sheep tethered in position thereon; said sub-frame being adapted by its mounting on said support frame to be rotated and tilted relative thereto to receive a sheep on said rollers when the weight of said sheep assists in the return of said sub-frame to a substantially horizontal position; said sub-frame can then be rotated so as to again axially align with the support frame for a shearing operation to commence; further rotation and tilting of said sub-frame relative to said support frame at the end of a shearing operation being effected for the subsequent release of the now shorn sheep.

Figure 1:
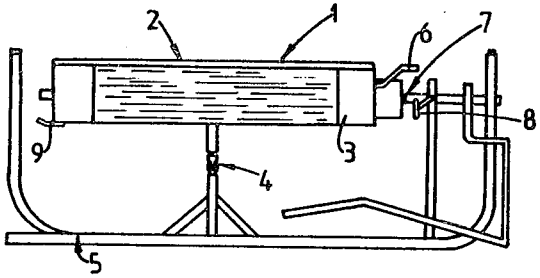
Figure 5:
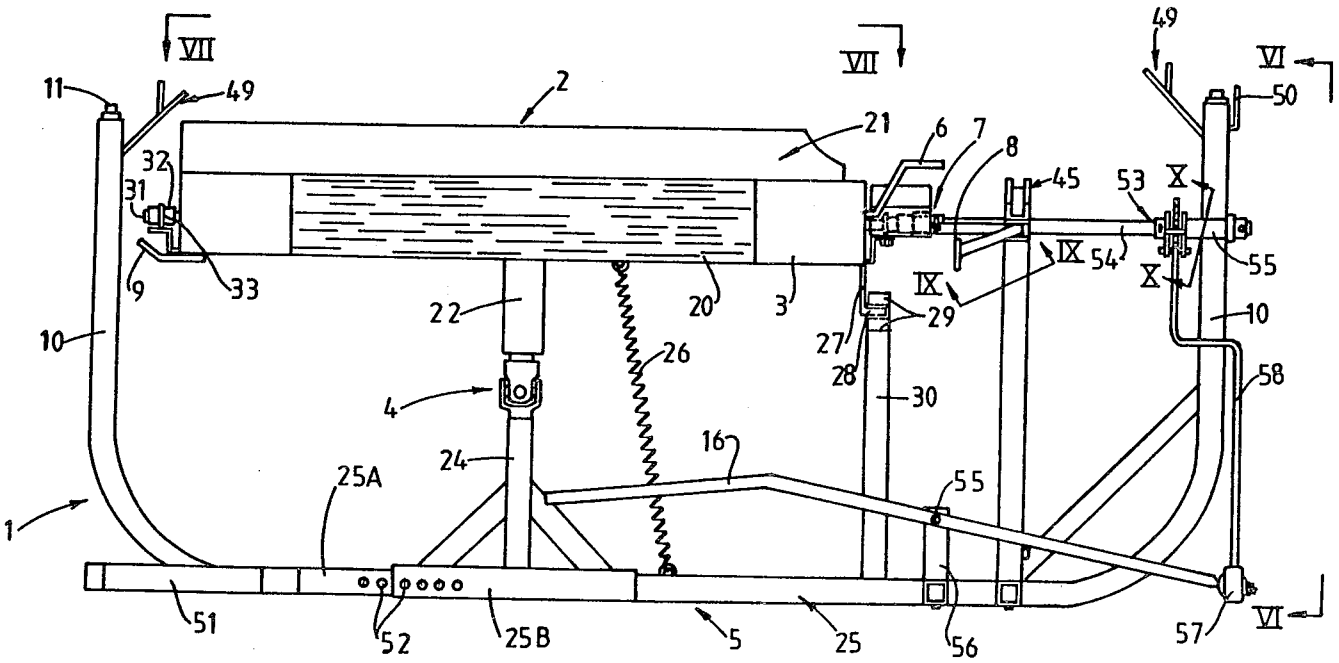
Figure 11:
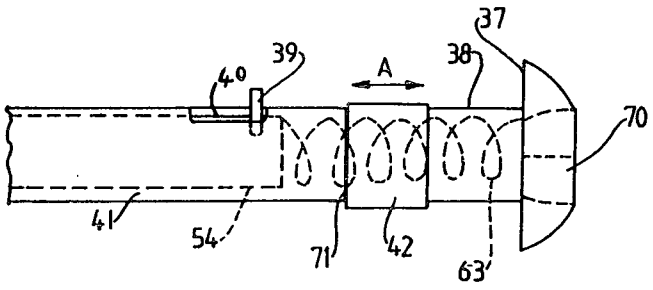
Figure 5A:
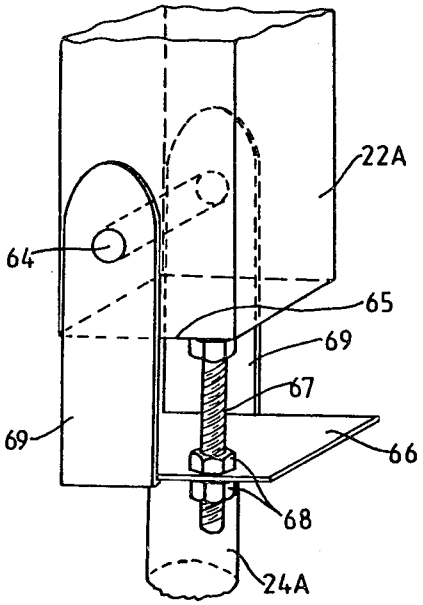
Figure 8:
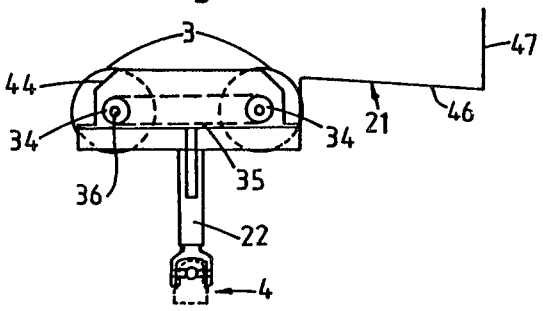
Figure 7:
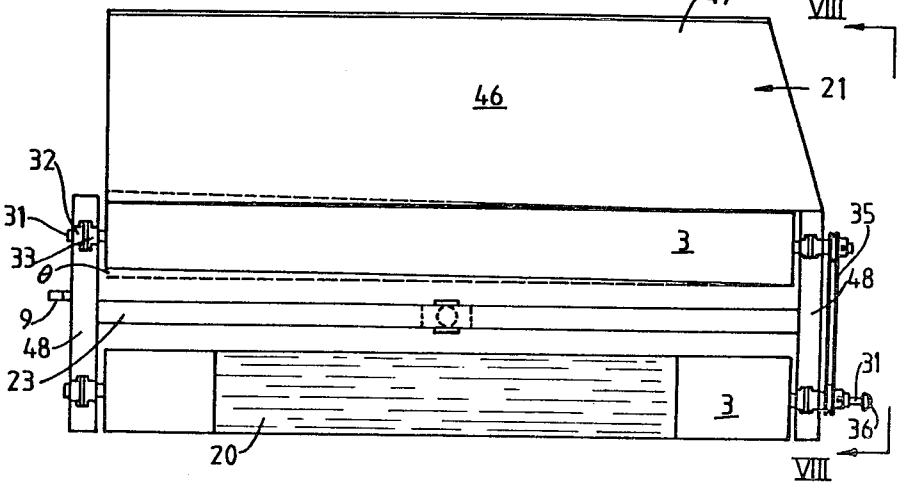
Figure 6:
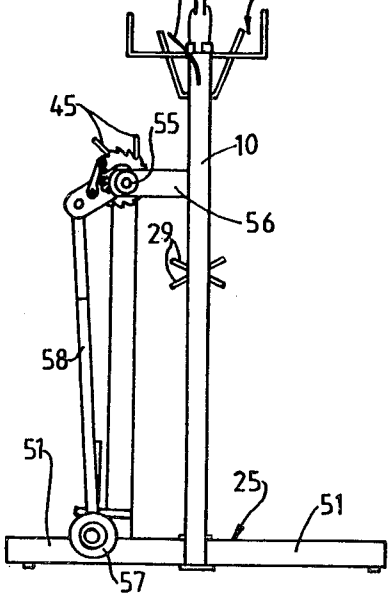
Figure 10:
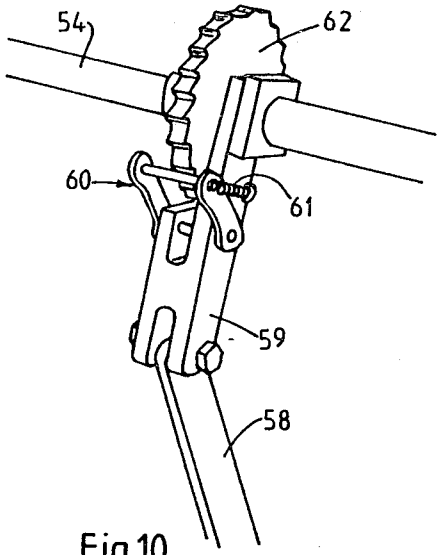
Figure 9:
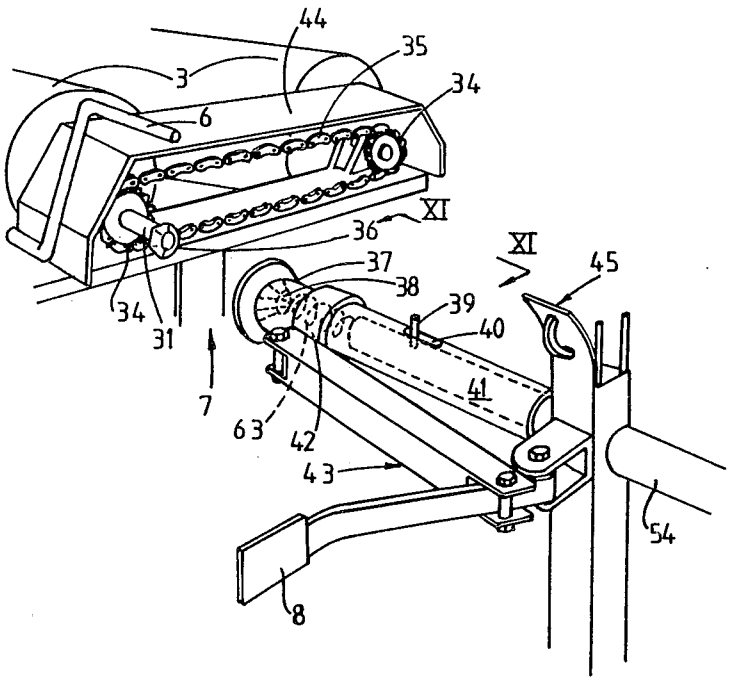

One embodiment of the present invention will now be described by way of example with reference to the accompanying drawings;

FIGS. 1 to 4: show, very diagrammatically, a sheep shearing apparatus according to one embodiment of the invention prior, during and subsequent to a sheep shearing operation;

FIG. 5: shows in greater detail a side view of the sheep shearing apparatus of FIG. 1;

FIG. 6: shows an end view along arrows V1—V1 of the support frame of FIG. 5;

FIG. 7: shows a plan view of the sub-frame of the apparatus of FIG. 1 along arrows V11—V11 of FIG. 5;

FIG. 8: shows an end view along arrows V111—V111 of the sub-frame of FIG. 7;

FIG. 9: shows in greater detail a view along arrows IX—IX of FIG. 5;

FIG. 10: shows in greater detail a view along arrows X—X of FIG. 5;

FIG. 5A: shows an alternative form of sub-frame/-support frame coupling for use in another embodiment of the invention;

FIG. 11: shows a view along arrows XI—XI of FIG. 9.

In another embodiment a bracket 50 may also be provided around which the rope end can be wound after it has been passed through the cleats 11.

The framework members 10 can extend downwardly to the bottom of the apparatus so as to form part of the framework base 25, together with angularly extended base members 51 diverging outwardly therefrom.

The base 25 on the left hand side of FIG. 5 is shown including a plurality of adjustment holes 52 whereby a first base member 25A can be telescoped within base member 25B so that the overall length of the apparatus 1 can accordingly be adjusted. A pin (not shown) may in known manner be passed through the respective holes 52 once aligned and once the required overall length has been achieved. Such length adjustment can be desirable to enable the apparatus 1 to accommodate different sized animals such as stud rams, goats and the like.

In order to rotate the rollers 3 it is necessary for a rotating drive to be applied through drive coupling 7 between socket member 37 and the male driven member 36.

A ratchet drive arrangement 53 may suitably be provided for this purpose providing a rotation of a drive shaft 54 by operation of the foot lever 16.

The foot lever 16 is shown pivoted at 55 to a base member 56 and connected through a ball joint 57 with an arm 58.

At its upper end the arm 58, see FIG. 10 particularly, is pivotally connected with a bifurcated arm 59 having a pawl 60 biassed by spring 61 thereon into engagement with a ratchet 62.

A single downward movement of the lever 16 will thus be translated into an upward movement of the linkage 58, arm 59 and pawl 60 thus rotating the ratchet 62 through a predetermined distance. Release of the foot lever 16 will then enable the pawl 60 to return to the position shown in FIG. 10 ready for its next operation of the ratchet 62.

In one embodiment of the invention each operation of the foot lever 16 can move the ratchet 62 through a distance represented by four of its teeth to thus rotate drive shaft 54 by a corresponding distance. This movement of the drive shaft 54 will then be transmitted through the drive coupling to the first roller 3 and through the ratchets 34 and chain 35 to the other roller 3. At its outer end the drive shaft 54 may be mounted in a bush arrangement 55 mounted on the frame member 10 by mounting bracket 56.

It is thus seen that with the socket member 37 in its retracted position to thus decouple the drive to the rollers 3 the sub-frame can be tilted down to receive a sheep before being returned to the horizontal position and locked and the drive re-coupled. Incremental rotation of the rollers then enables the sheep to be rotated until totally shorn. At that time the sub-frame can be again released and tilted to an opposite side to release the sheep before being swung back again to the first side to receive the next sheep.

The effective working life of a shearer is substantially reduced due to the manner in which present day shearing of sheep is carried out. This generally entails the catching of a sheep which is then immobilized on its back by the shearer who bends over it to effect the required shearing strokes along the animal's fleece prior to the shorn sheep being released and the operation repeated on the next sheep.

The continual stress that is thereby imposed on the shearer's back means however that only relatively young and fit shearers can meet the daily output required.

However the present invention in its preferred embodiment provides a sheep shearing apparatus which facilitates the speedy and efficient successive shearing of a large number of sheep, reducing the physical effort required and the strain on the shearer's back thus enabling relatively old shearers to extend their working life and also enabling shearers with back trouble to continue shearing.

Additionally the sheep shearing apparatus of the present invention can be of valuable assistance to a shearer with little experience and a small flock requiring to be sheared.

The broad aim of the invention in its preferred embodiment is to provide a sheep shearing apparatus which will enable a shearer to shear a sheep in under two minutes without any unnecessary bending of his back.

Referring to the accompanying drawings and firstly to FIGS. 1 to 4 thereof a sheep shearing apparatus according to one embodiment of the present invention is referenced generally by arrow 1.

Figure 2:
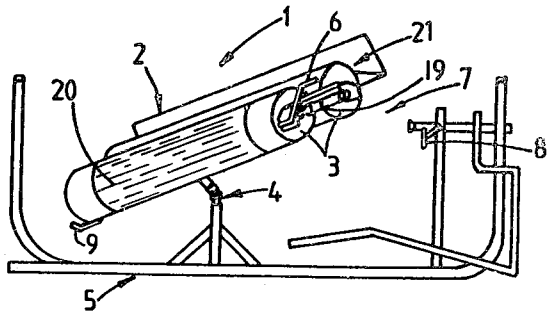

Referring particularly to FIGS. 1 and 2 the apparatus 1 is shown having a sub-frame 2 comprising a pair of rollers 3.

The sub-frame 2 is shown coupled through a joint 4 with a support frame 5.

The joint 4 is to enable the sub-frame to tilt and rotate relative to the support frame 5.

A handle 6 fixed to the sub-frame 2 enables a shearer to hold onto the sub-frame in controlling its movement relative to the support frame 5.

In FIG. 1 a drive coupling 7 is shown connected with one of the rollers 3. Operation of a lever 8 can, as described below, release the drive coupling enabling the sub-frame to be swivelled (into the paper) as shown in FIG. 2 so that an end support 9 can rest on the ground and a sheep requiring to be sheared can be lent against the sub-frame centrally between the rollers 3.

The weight of the sheep laid on its back on the rollers 3 will assist the return of sub-frame 2 to a substantially horizontal position and with its rotation relative to the support frame 5 the drive coupling 7 can be re-engaged.

At each end of the support frame 5 vertical supports 10 include at their upper ends cleats 11 through which a rope 12 can pass and be held. At the end of the rope 12 a leg fetter 13 is shown suitably comprising a cross bar 14 from which depend a pair of rope loops 15 which can be looped around a respective leg of the sheep and tightened as tension is placed on the rope 12.

Tensioning the rope 12 to a desired degree will stretch the sheep's legs and immobilize the sheep.

An operating lever 16 can be operated by the shearer's foot to drive through a linkage 17 a crank drive 18. This drive is transmitted to a roller 3 through the drive coupling 7. A chain 19 connecting the respective drive shafts of the rollers 3 together causes a common rotation of the rollers 3.

One of the rollers 3 is shown having a cover or coating 20 with a rough surface to assist the opposite rotation of the sheep with the rotation of the rollers 3.

Figure 3:
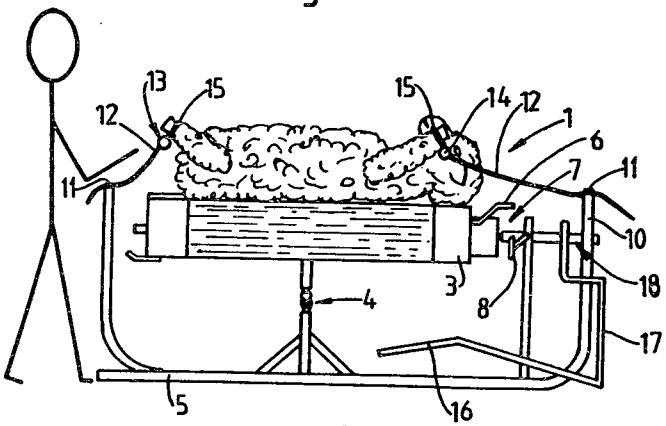

The shearer will thus start off with the sheep tethered in the position shown in FIG. 3 lying on its back on the rollers 3. The belly fleece can then be removed before foot pressure on the lever 16 will rotate the sheep a desired amount as the subsequent shearing strokes are effected.

Figure 4:
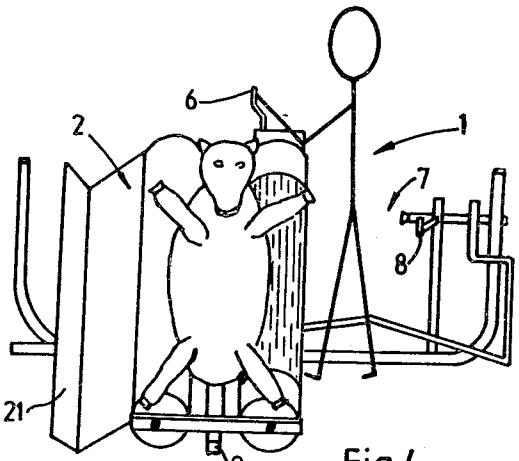

After the rotation of the sheep in a completely controlled movement by the incremental rotation of the rollers 3 the sheering will be completed. At this time the fetters 13 can be released and the drive coupling 7 released by means of the lever 8. The sub-frame 2 can then be turned in the opposite direction from that shown in FIG. 2 (out of the page) as shown in FIG. 4 so that the tilted sub-frame 2 rests of the bracket 9 on the ground and the shorn sheep released into the tally pen.

The sub-frame 2 can then be immediately swung back to the opposite side of the support frame 5 into the position shown in FIG. 2 for the next sheep to be loaded onto the rollers 3.

A tray 21 along one side of the sub-frame 2 collects the fleece during the shearing operation for speedy and efficient collection and transmission to the wool table.

Referring now to FIG. 5 of the accompanying drawings the sub-frane 2 is shown coupled with the support frame 5 by means of a universal joint 4. This joint 4 is shown providing a connection between a sub-frame support member 22, itself connected with a longitudinal sub-frame support member 23 (see FIG. 7), and a vertical support member 24 extending upwardly from a framework base 25.

A spring 26 is shown connecting the bottom of the sub-frame 2 with the base 25. When the sub-frame 2 is moved from its horizontal position to receive a sheep the spring 26 will thus assist in returning the sub-frame to the horizontal position.

The bottom of the sub-frame 2 is also shown provided with a downwardly depending "L" shaped bracket 27 the bottom arm of which 28 is shown in FIG. 5 accommodated within a pair of spaced apart arms 29 extending outwardly from a vertical frame member 30. The engagement of the bracket 27 within the arms 29 in the horizontal position thus assists in holding the sub-frame in this position so that reliance for this holding action is not placed on the interconnection between the sub-frame 2 and the frame 5 through the drive coupling 7.

An adjustable abutment (not shown, but see FIG. 5A) would preferably be provided in conjunction with the joint 4 so that the sub-frame member 22 is not able to travel past a vertical position from its tilted positions shown in FIGS. 2 and 4. Such an adjustable abutment would also assist in determining the horizontal position of the sub-frame 2 at which the drive coupling 7 can be re-engaged and the arm 28 of the bracket 27 engaged between the holding arms 29.

The sub-frame 2, as shown in FIGS. 5, 7, 8 and 9 particularly, includes a pair of elongate rollers 3.

The rollers 3 may suitably comprise elongate plastic or metal tubes or cylinders mounted between respective pairs of end plates and supported on shafts 31 mounted in bushes 32 secured by U-bolts 33.

Referring particularly to FIG. 7, while the front roller 3 is shown substantially parallel with the longitudinal axis of the sub-frame, the back roller 3 is shown to be inclined away from the longitudinal axis by an amount shown as 0°. This is to give extra width between the rollers where the pelvis of the sheep is to be accommodated and enables pressure to be put on the sheep's nerve system in the pelvic/lumber region which tends to immobilize it.

Where the rollers 3 are parallel and sufficiently close to enable lambs to be sheared thereon, it has been found that a sheep's nerve system in the pelvic/lumbar region can be pinched causing the sheep to be highly agitated.

The angle 0° may be of the order of 1° or 2° so that with a roller length of the order of 1150 mm an increase in width i.e. over that which would be present if the rollers were parallel, of the order of 15 to 30 mm can be achieved between the rollers in that area.

This, it has been found, enables the sheep to be held on its back between the two rollers 3 with the added width pressuring but not pinching the nervous system of the sheep about its lumbar/pelvic region to immobilize it.

Referring particularly to FIG. 9, at the drive end of the shafts 31, sprockets 34 are shown coupled by a chain 35. The front shaft 31, or alternatively an extension of the front sprocket 34, has a shaped enlarged end 36 forming the male part of the drive coupling 7.

The drive coupling 7 on the drive side includes a female socket member 37 including a correspondingly shaped recess 70 adapted to receive and rotate the male portion 36.

Referring also to FIG. 11, the socket member 37 is shown provided at the reduced end 38 of a tube 41 within which the end of the drive shaft 54 extends. A pin 30 secured to the drive shaft 54 adjacent its end extends through a slot 40 in the tube 41. In FIGS. 9 and 11 the drive coupling 7 is shown in its disconnected position with the socket member 37 withdrawn against the bias of a spring 63 positioned within the tube 41 and its reduced end 38 and between the end of the drive shaft 54 and the back of the socket member 37.

A collar 42 is shown mounted about the reduced tube end 38 and can slide therealong in a direction indicated by arrows A. The tube end 38 is also free to rotate within the collar 42. The collar 42 is shown connected with a linkage 43 connecting it with a lever 8 which can be operated by the shearer's knee in withdrawing the socket member 37 from the male portion 36 in disconnecting the drive coupling 7. The spring 63 will normally bias the socket member 37 into engagement with the male portion 36. Operation of the lever 8 will cause the collar 42 to slide along the reduced tube end 38 until it abut the shoulder 71 on the tube 41. Continued pressure on the lever 8 will withdraw the tube 41 against the bias of the spring 63 until the pin 39 comes to the end of the slot 40, which is the position shown in both FIGS. 9 and 11. The pin 39 also defines the amount of forward travel of the tube 41 and socket 37 relative to the end of the drive shaft 54 by its engagement with the other end of the slot 40.

The drive coupling 7 will thus be biassed into its operative condition but can be readily disconnected by the shearer simply by operation of the lever 8.

A cowl or cover 44 is shown provided about the chain 35 and sprockets 34 so as to protect against fleece getting entangled therein.

A holder 45 may be provided as shown in FIG. 9 to hold the shearing gun when not being used.

The tray 21 positioned on the far side of the rollers 3 is shown to have an inclined floor 46 and a back wall 47 facilitating the receipt in the tray 21 of the fleece and its rapid collection and transference to the wool table.

The supporting structure of the sub-frame 2 is seen to comprise the longitudinal horizontal support member 23 having at each end transverse sub-frame members 48 providing a support for the shafts 31. It is mentioned that in FIG. 7 the cover 44 and handle 6 have been omitted for clarity.

The roughened surface or cover 20 for at least one of the rollers 3 may for example be the type of material sold for providing a non-slip surface around swimming pools or may alternatively be a roughened surface formed on the actual material of the roller 3 itself.

Referring now to FIG. 6 of the accompanying drawings an end elevational view shows an end frame member 10 having at its upper end a pair of spring biassed cleats 11 biassed together so as to grip a rope which has been pulled therethrough so as to maintain the tension on the rope. Such cleats 11 are well known for use in boats in maintaining tension on sail ropes.

Secured with each frame member 10 adjacent the cleates 11 are holders 49 on which the bars 14 of the fetters 13 can be accommodated until needed for use.

Referring now to FIG. 5A an alternative embodiment of the invention can utilize instead of the universal joint 4 shown in FIG. 5 another suitable type of coupling enabling the tilting and rotational movement between the sub-frame 2 and the support frame 5.

Thus in FIG. 5A the sub-frame member 22A depending downwardly from the sub-frame longitudinal member 23 is shown pivotally mounted on a pin 64 extending between a pair of spaced apart support arms 69. The arms 69 at their respective bottoms ends extend into a plate member 66.

An adjustable stop member comprising a bolt 67 threadedly engaged with nuts 68 on either side of the plate member 66 provides an adjustable stop engageable with the base 65 of the framework member 22A when that member has returned to a vertical position i.e. the sub-frame 2 has returned to a horizontal position. The plate member 66 is shown connected with a downwardly depending shaft member 24A which can be rotatably fitted within a base framework member 24 such as shown in FIG. 5 utilizing as necessary suitable bearings, bushes or the like to provide a rotational relationship therebetween.

Thus the sub-frame 2 can be tilted relative to the framework 5 by the pivoting of the member 22A about the pivot pin 64 and the sub-frame 2 rotated relative to the framework 5 by the rotational relationship between the shaft 24A and the framework member 24.

Other couplings enabling the required tilting/rotational relationship between the sub-frame 2 and the support frame 5 will be apparent.

It will be appreciated therefore that a small flock could be sheared utilizing the apparatus of the present invention in a one man operation but more particularly that with the shearing platform being at approximately waist height the back bending required for normal shearing can be totally avoided.

Where in the aforegoing description reference has been made to specific components or integers of the invention having known equivalents such equivalents are herein incorporated as if individually set forth.

Although this invention has been described by way of example and with reference to one possible embodiment thereof it is to be understood that modifications or improvements may be made thereto without departing from the scope of the invention as defined in the appended claims.

I claim;

1. An animal handling device for shearing of sheep comprising a support frame and a sub-frame coupled thereto enabling tilting and rotational movement therebetween, said sub-frame including a pair of elongate rollers connectible with a drive means to be rotated in a common direction and to rotate a sheep tethered in position thereon; said sub-frame being adapted by its mounting on said support frame to be rotated and tilted relative thereto to receive a sheep on said rollers when the weight of said sheep assists in the return of said sub-frame to a substantially horizontal position; and sub-frame can then be rotated relative to said support frame so as to again axially align with the support frame for a shearing operation to commence; further rotation and tilting of said sub-frame relative to said support frame at the end of a shearing operation being effected for the subsequent release of the now shorn sheep, and wherein said drive means is connectible to said rollers to drive same through a drive coupling means which can be disconnected to enable said sub-frame to be moved relatively to said support frame.

2. An animal handling device as claimed in claim 1 wherein said sub-frame is connected with a substantially vertical support member of said support frame by a pivotal joint.

3. An animal handling device as claimed in claim 2 wherein an adjustable stop member associated with said pivotal joint provides a stop for said sub-frame when it returns to said substantially horizontal position.

4. An animal handling device as claimed in claim 3 wherein a spring is connected between said sub-frame and said support frame to bias said sub-frame towards said substantially horizontal position.

5. An animal handling device as claimed in claim 1 wherein said support frame includes a base including a pair of telescopic base members which can be moved relative one with the other to adjust the overall length of said support frame.

6. An animal handling device as claimed in claim 1 wherein said support frame includes at either end thereof a substantially vertical end member at a top end of which is provided a respective rope engaging means adapted to receive and hold a rope under tension of an animal leg fetter means.

7. An animal handling device as claimed in claim 1 wherein said drive coupling means comprising a male coupling member engagable with a female socket member, said female socket member being biased into engagement with said male coupling member but movable therefrom.

8. An animal handling device as claimed in claim 7 wherein said female socket member is mounted at the end of a tube, a drive shaft extends into and is coupled with to rotate said tube, a spring is mounted within said tube between a rear surface of said member and a free end of said drive shaft, a collar is operable by a lever means to slide along said tube and to engage a shoulder provided thereon to move said tube and said socket member against said bias of said spring towards said free end of said drive shaft and away from said male coupling member, said drive means comprising a ratchet engageable by a spring biassed pawl means, said pawl means being connected by a linkage means to a foot lever means operable by the shearer's foot.

9. An animal handling device as claimed in claim 1 wherein the length of said sub-frame and its mounting with said support frame is such that in its tilted positions to receive and discharge sheep a lower end thereof can abutt against the ground and wherein each of said rollers has an outwardly extending shaft at each respective end thereof, two of said shafts of respective rollers at adjacent ends thereof being provided with a respective sprocket and a chain connecting said sprockets together so as to cause said common rotation of said rollers, a tray extending along side one of said rollers and having a floor extending downwardly therefrom to a rear wall, said tray being adapted to receive fleece as it is moved from the sheep.

10. An animal handling device as claimed in claim 1 wherein at least one of said rollers is provided with a roughened surface or cover so as to facilitate the gripping and rotation of the sheep, said sub-frame including a downwardly depending bracket and said support frame including a bracket receiving means so positioned that it can receive and hold said bracket when said sub-frame is in its substantially horizontal position and wherein one of said rollers is inclined away from the other of said rollers so as to increase the width therebetween in the area along said rollers where the sheep's pelvic region is to be supported such that pressure on but not pinching of the sheep's nerve system in the pelvic/lumbar region can occur.

11. An animal handling device for shearing of sheep comprising a support frame and a sub-frame coupled thereto enabling tilting and rotational movement therebetween, said sub-frame including a pair of elongate rollers to be rotated in a common direction and to rotate a sheep tethered in position thereon; said sub-frame being adapted by its mounting on said support frame to be rotated and tilted relative thereto to receive a sheep on said rollers when the weight of said sheep assists in the return of said sub-frame to a substantially horizontal position; said sub-frame can then be rotated so as to again axially align with the support frame for a shearing operation to commence; further rotation and tilting of said sub-frame relative to said support frame at the end of a shearing operation being effected for the subsequent release of the now shorn sheep, and wherein said drive means is connectible to said rollers to drive same through a drive coupling means which can be disconnected to enable said sub-frame to be moved relatively to said support frame, said drive coupling means comprising a male coupling member engagable with a female socket member, said female socket member being biased into engagement with said male coupling member but movable therefrom, and wherein said female socket member is mounted at the end of a tube, a drive shaft extends into and is coupled with to rotate said tube, a spring is mounted within said tube between a rear surface of said socket member and a free end of said drive shaft, a collar is operable by a lever means to slide along said tube and to engage a shoulder provided thereon to move said tube and said socket member against bias of said spring towards said free end of said drive shaft and away from said male coupling member, said drive means comprising a ratchet engagable by a spring biased pawl means, said pawl means being connected by a linkage means to a foot lever means operable by the shearer's foot.

* * * * *